US010363652B2

(12) United States Patent
Kim

(10) Patent No.: US 10,363,652 B2
(45) Date of Patent: Jul. 30, 2019

(54) LOW-NOISE HYDRAULIC HAMMER

(71) Applicant: S.M METAL CO., LTD., Ansan-si, Gyeonggi-do (KR)

(72) Inventor: Sung Kew Kim, Ansan-si (KR)

(73) Assignee: S.M METAL CO., LTD., Ansan-si, Gyeonggi-do (KR)

( * ) Notice: Subject to any disclaimer, the term of this patent is extended or adjusted under 35 U.S.C. 154(b) by 699 days.

(21) Appl. No.: 15/027,460

(22) PCT Filed: Nov. 21, 2014

(86) PCT No.: PCT/KR2014/011293
§ 371 (c)(1),
(2) Date: Apr. 6, 2016

(87) PCT Pub. No.: WO2015/080439
PCT Pub. Date: Jun. 4, 2015

(65) Prior Publication Data

US 2016/0250739 A1 Sep. 1, 2016

(30) Foreign Application Priority Data

Nov. 28, 2013 (KR) ..... 10-2013-0146192

(51) Int. Cl.

| | |
|---|---|
| ***B65D 8/00*** | (2006.01) |
| ***B25D 17/11*** | (2006.01) |
| ***B25D 9/00*** | (2006.01) |
| ***B25D 9/04*** | (2006.01) |

(52) U.S. Cl.
CPC ..... *B25D 17/11* (2013.01); *B25D 9/00* (2013.01); *B25D 9/04* (2013.01); *B25D 2217/0015* (2013.01); *B25D 2217/0023* (2013.01)

(58) Field of Classification Search
CPC .. B65D 17/11; B65D 9/04; B65D 2217/0015; B65D 2217/0011; B65D 2217/0023; B25D 16/00; B23B 45/16
USPC ..... 173/128, 130, 210
See application file for complete search history.

(56) References Cited

U.S. PATENT DOCUMENTS 3,651,873 A * 3/1972 Uebel ..... E02D 11/00 173/202
3,792,738 A * 2/1974 Mori ..... B25D 9/12 173/202
3,796,271 A * 3/1974 Amtsberg ..... E21B 6/00 173/102
3,827,507 A * 8/1974 Lance ..... B25D 9/12 173/127

(Continued)

FOREIGN PATENT DOCUMENTS

JP 2013-063631 * 12/2013 ..... B65D 16/00
JP WO 2014/156471 * 2/2014 ..... B65D 16/00

(Continued)

*Primary Examiner* — Gloria R Weeks
(74) *Attorney, Agent, or Firm* — Rabin & Berdo, P.C.

(57) ABSTRACT

The present invention relates to a hydraulic hammer, and more specifically, to a low-noise hydraulic hammer, wherein an impact bar that is accommodated inside of a piston is inclined so as not to contact the inside of the piston thereby preventing cracks, and a noise insulating material or a heat sink is installed inside the piston or outside the impact bar, thereby reducing noise and improving heat radiation performance.

17 Claims, 4 Drawing Sheets

(56) References Cited

U.S. PATENT DOCUMENTS 4,043,405 A * 8/1977 Kuhn ..... E02D 7/00 173/127
4,071,094 A * 1/1978 Kilin ..... B25D 17/08 173/162.2
4,114,950 A * 9/1978 Cooper ..... B25D 9/14 173/46
4,479,551 A * 10/1984 Justus ..... B25D 9/12 173/112
5,052,498 A * 10/1991 Gustafsson ..... B25D 11/005 173/118
5,492,183 A * 2/1996 Sollami ..... E21B 3/02 173/198
5,567,867 A * 10/1996 Nazar ..... G01M 7/08 173/90
5,575,051 A * 11/1996 Moore ..... B21J 15/043 173/162.1
6,227,309 B1 * 5/2001 Henke ..... B25D 16/00 173/109
6,318,478 B1 * 11/2001 Kaneko ..... B25D 17/24 173/135
6,415,876 B1 * 7/2002 Bollinger ..... B23D 51/18 173/135
6,976,545 B2 * 12/2005 Greitmann ..... B25D 16/003 173/104
7,055,621 B2 * 6/2006 Wentworth ..... E21B 4/14 173/128
7,469,751 B2 * 12/2008 Gien ..... E21B 4/14 173/15
7,628,221 B2 * 12/2009 Hartmann ..... B25D 11/005 173/104
7,845,428 B2 * 12/2010 Sakamaki ..... B23B 31/1071 173/104
8,387,845 B2 * 3/2013 Franz ..... B25C 1/14 173/210
8,651,198 B2 * 2/2014 Ito ..... B25B 21/02 173/109
9,016,396 B2 * 4/2015 Andersson ..... B25D 17/06 173/128
9,211,639 B2 * 12/2015 Hecht ..... B25D 11/062
2002/0011360 A1 * 1/2002 Gien ..... E21B 4/14 175/296
2003/0010514 A1 * 1/2003 Taga ..... B25B 21/00 173/213
2003/0221847 A1 * 12/2003 Funfer ..... B25D 11/005 173/201
2004/0206525 A1 * 10/2004 Rask ..... B25D 11/102 173/205
2004/0226729 A1 * 11/2004 Mikiya ..... B25F 5/006 173/128
2007/0295520 A1 * 12/2007 Comarmond ..... E02D 3/046 173/90
2009/0078468 A1 * 3/2009 Paasonen ..... B25D 16/00 175/322
2010/0270049 A1 * 10/2010 Baumann ..... B23B 51/18 173/218
2012/0145422 A1 * 6/2012 Nickels ..... E02F 3/966 173/46
2014/0318909 A1 10/2014 Bakke
2015/0129269 A1 * 5/2015 Muuttonen ..... E21B 1/02 173/105
2015/0376949 A1 * 12/2015 Vatne ..... E21B 4/14 173/136

FOREIGN PATENT DOCUMENTS

KR 10-2009-0022475 A 3/2009
KR 10-0906468 B1 7/2009
KR 10-1179956 B1 9/2012
WO WO 2013-085394 A1 6/2013

* cited by examiner

LOW-NOISE HYDRAULIC HAMMER

TECHNICAL FIELD

The present invention relates to a hydraulic hammer, and more specifically to a low-noise hydraulic hammer, capable of preventing cracks by inclining an impact bar received in a piston not to make contact with an inner part of the piston, and reducing noise and improving heat radiation performance by mounting a noise insulating material or a hint sink inside the piston or outside the impact bar.

BACKGROUND ART

In general, a hydraulic hammer, such as a rock drill or an excavator, is essentially used to effectively perform a crushing or excavating work in various civil engineering works.

As shown in FIG. 1, the hydraulic hammer includes a housing 1, a cylinder 2 and a piston 3 provided in the housing 1 to operate using oil pressure or air pressure, and a striking part 4 provided at the front of the cylinder 2, struck by the piston 3, and having a pointed tip to perform the excavating or crushing work. When the piston 3 coupled to the cylinder strikes the striking part 4 in the excavating work using the oil pressure, noise and vibration extremely seriously occur. Noise of 80 dB or more causes a worker or inhabitants to have extremely severe unpleasant feeling and exerts an advert influence on a worker or inhabitants.

In order to solve the above problem, according to the related art, as shown in FIG. 2, a receiving part 5 is formed with a predetermined diameter and a depth at an end of the piston 3 of the cylinder 2 provided in the housing 1 to operate using the oil pressure or the air pressure, and an impact bar 6 mounted on the striking part 4 is inserted into the receiving part 5 as shown in FIG. 2.

In other words, the impact bar 6 which is a portion of the striking part 4 is inserted into the piston 3.

In this case, the piston 3 is moved forward to strike the impact bar 6 mounted on the striking part 4, and the striking is performed in the receiving part 5, so that the noise may be significantly attenuated.

However, according to the related art, since the impact bar is inserted into the piston as described above, the outer surface of the impact bar mutually makes contact with the inner surface of the piston so that the impact bar and the piston may be cracked.

This is because the striking part may be moved forward and backward in a direction inclined at a predetermined angle instead of a correct linear direction.

Accordingly, as described above, cracks may be made, and heat radiation may be difficult in the configuration of the conventional receiving part, so that durability and strength may be degraded.

Meanwhile, since the hydraulic hammer is a well-known technology, and described in detail in the following prior art, the detailed description and drawings of the hydraulic hammer will be omitted in the specification of the present invention.

DISCLOSURE

Technical Problem

The present invention is made in order to solve the above-described problems, and an object of the present invention is to provide a low-noise hydraulic hammer in which an impact bar and an inner part of a piston are inclinedly formed to being prevented from being mutually scratched and to smoothly radiate heat, thereby preventing cracks and improving durability and strength.

Technical Solution

According to the present invention, in order to accomplish the object, there is provided a low-noise hydraulic hammer including an impact bar (200) formed in a striking part (300) and inserted into a receiving part (120) in a piston (100). Both inner lateral sides of the receiving part (120) are inclinedly formed such that a diameter of the receiving part (120) is increased toward the impact bar (200), and the impact bar (200) is received in the receiving part (120) to make contact with the piston (100), formed with a diameter reduced toward the receiving part (120), and spaced apart from the both inner lateral sides of the receiving part (120) by a specific distance.

In this case, a contact part (130) serving as a bottom surface of the receiving part (120) and making contact with the impact bar (200) may protrude toward the impact bar (200) by a predetermined height, and both sides of the contact part (130) may be formed with buffer grooves (140) curved with a predetermined curvature.

Further, the receiving part (120) may be provided on one lateral side thereof with a noise insulating material (160).

In addition, the impact bar (200) may be formed on an outer lateral side thereof with a plurality of steps (220) for attenuation of noise.

Further, a contact surface (230) serving as an outer surface of the impact bar (200) and facing a bottom surface (110*a*) of the piston (100) may be formed to be spaced apart from the bottom surface (110*a*) by a predetermined distance when the contact part (130) of the receiving part (120) strikes the impact bar (200).

Further, the low-noise hydraulic hammer may further include a buffer part (400) interposed between the bottom surface (110*a*) and the contact surface (230), and the buffer part (400) may include a spring.

In addition, the low-noise hydraulic hammer may further include a buffer part (400) interposed between the bottom surface (110*a*) and the contact surface (230), and the buffer part (400) may have a shape of a porous cylinder having a specific sectional surface and including an elastic material.

In addition, the low-noise hydraulic hammer may further include a plurality of heat sinks (500) mounted on the inner lateral side of the receiving part (120) or on the outer lateral side of the impact bar (200).

Further, the heat sinks (500) may have mutually different heights.

The advantages and the features of the present invention will be apparently comprehended by those skilled in the art based on the embodiments, which are detailed later in detail, together with accompanying drawings.

The terminology and words used herein and appended claims should be not interpreted as the meanings of commonly used dictionaries, but interpreted as having meanings according to the technical sprit of the present invention under the principle that the concepts of the terminology and the words can be defined by the inventor in order to explain the present invention in the best mode.

Advantageous Effects

As described above, according to the present invention, the impact bar and the inner part of the piston are inclinedly formed and thus prevented from being scratched due to the contact therebetween, so that the cracked can be prevented, and heat radiation performance is improved, so that the durability and the strength can be improved.

BEST MODE

Mode for Invention

Figure 1:
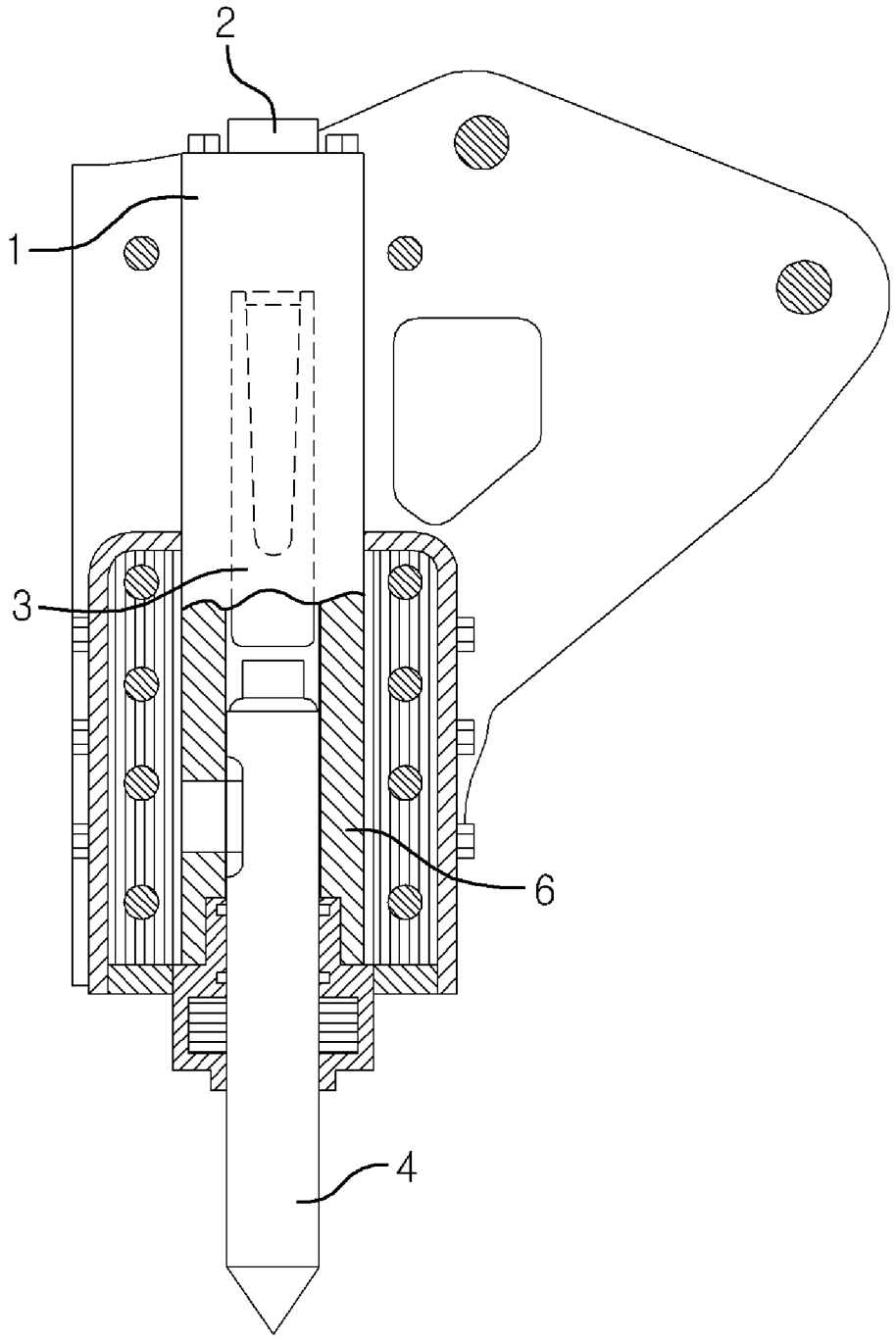
FIGS. 1 and 2 are schematic views illustrating a hydraulic hammer according to the related art.
Figure 2:
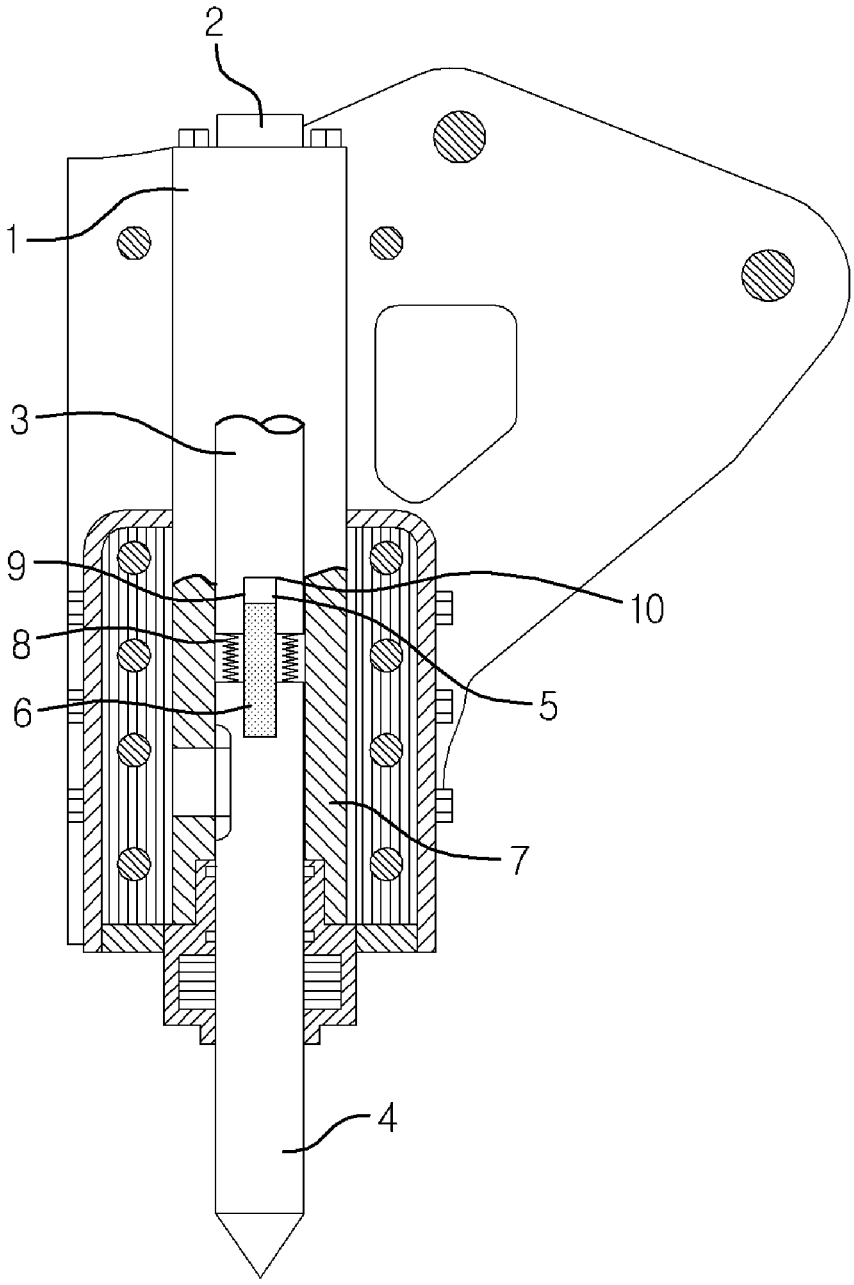

Hereinafter, an exemplary embodiment of the present invention will be described with reference to accompanying drawings. The thickness of lines and the size of components shown in the drawings may be exaggerated, omitted or schematically drawn for the purpose of convenience or clarity.

The following terminology are defined based on functions of components according to the present invention, and may have meanings varying according to the intentions of a user or an operator and the custom in the field of art. Accordingly, the terminology should be defined based on the whole context throughout the present specification.

In addition, the following embodiments does not limit the scope of the present invention, but provided for the illustrative purpose of components defined in appended claims of the present invention. It should be understood that all modification, equivalents, or alternatives of these embodiments are included within the scope of the present inventive concept.

Figure 3:
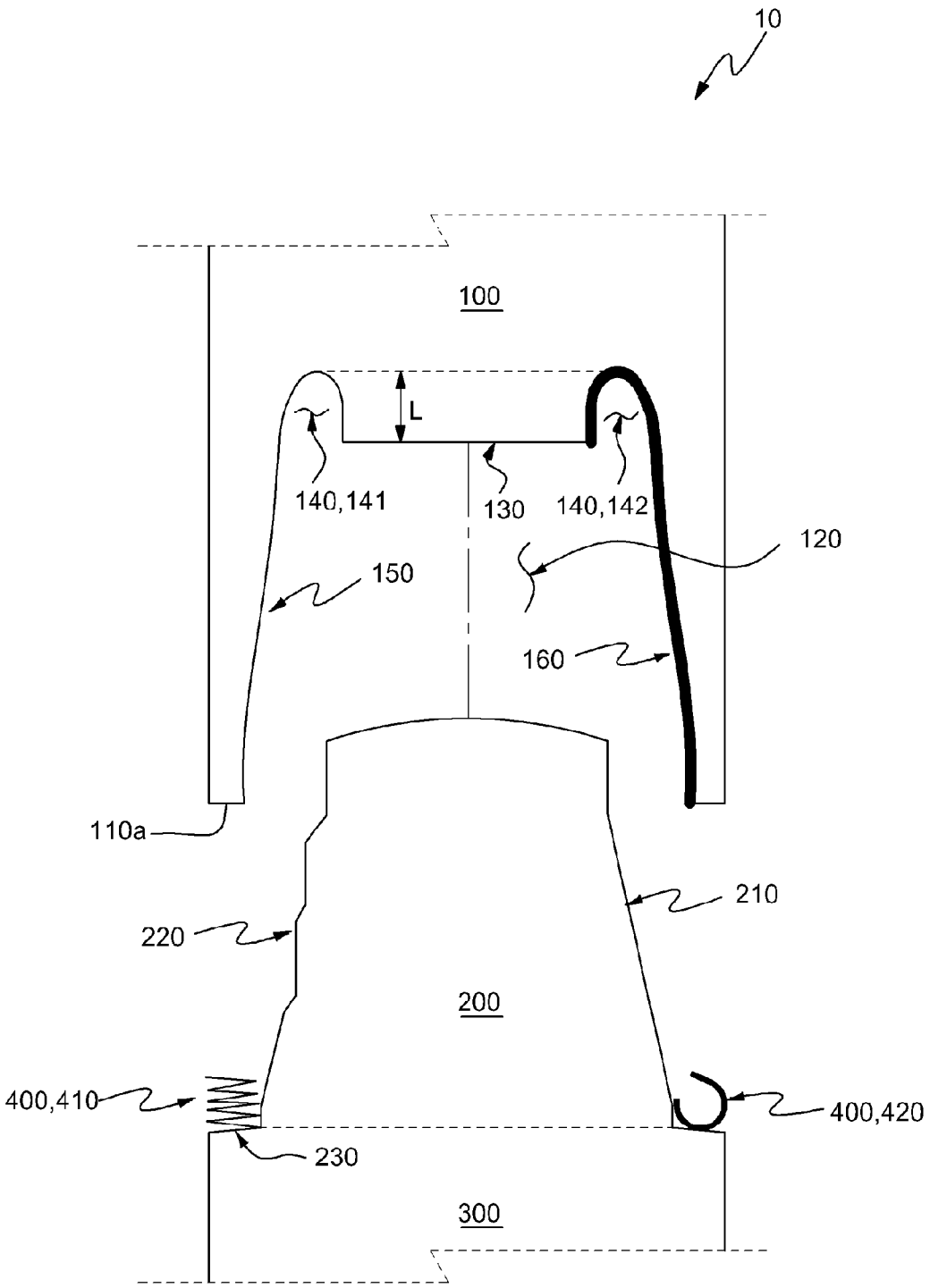
FIG. 3 is a schematic view illustrating the separation of a piston from a striking part in a hammer according to one embodiment of the present invention.
Figure 4:
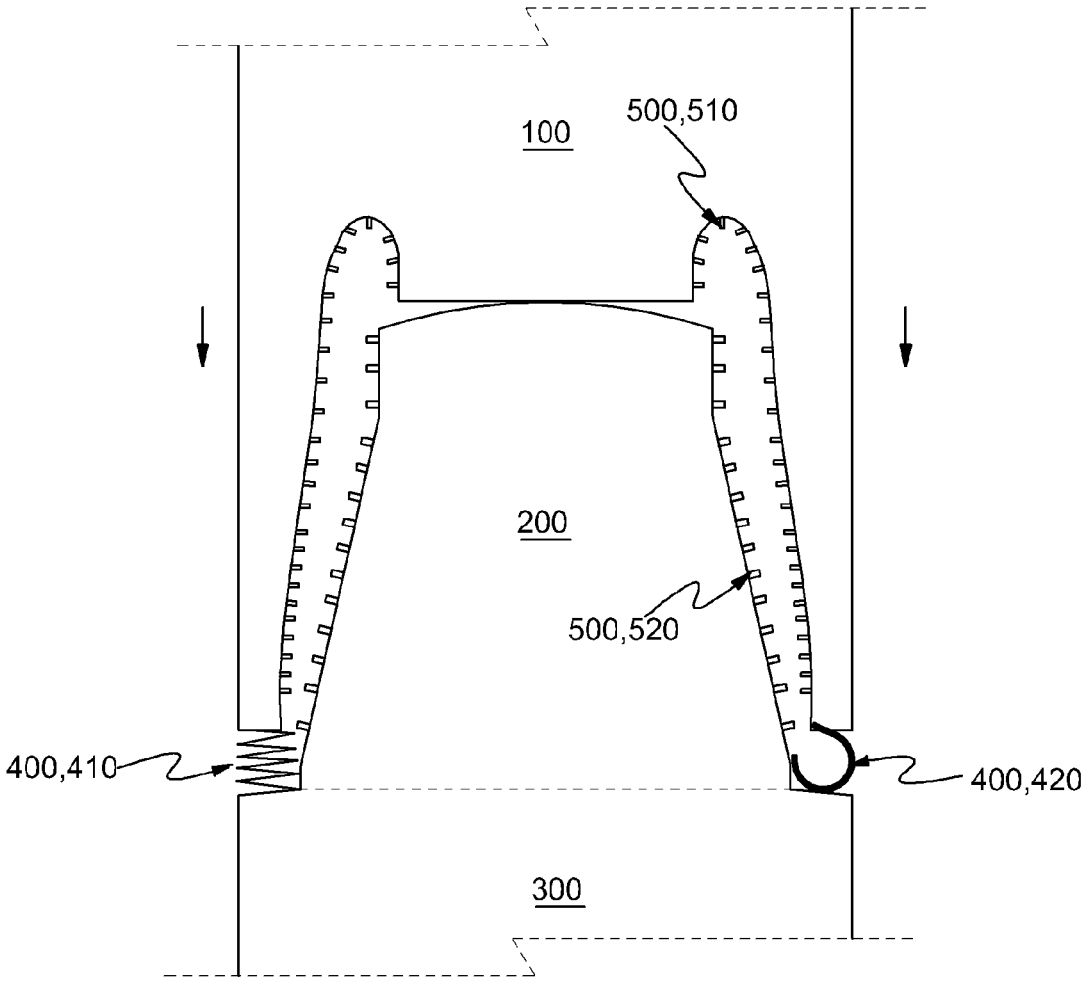
FIG. 4 is a schematic view showing the coupling between the piston and the striking part in the hammer according to one embodiment of the present invention.

In accompanying drawings, FIG. 3 is a schematic view illustrating the separation of a piston from a striking part in a hammer according to one embodiment of the present invention, and FIG. 4 is a schematic view showing the coupling between the piston and the striking part in the hammer according to one embodiment of the present invention.

Embodiment

A low-noise hydraulic hammer 10 according to one embodiment of the present invention has the same structure as that of the related art in that an impact bar 200 is formed in a striking part 300 and inserted into a receiving part 120 in a piston 100 as shown in FIG. 3.

In other words, the impact bar 200 protrudes from a tip of the striking part 300 to crush a workpiece, so that the impact bar 200 is inserted into the piston 100.

In this case, as the piston 100 is moved down, a contact part 130 of the receiving part 120 strikes the impact bar 200 so that the striking part 300 is moved forward and backward.

According to the present invention, both inner lateral sides of the receiving part 120 are inclined so that the diameter of the receiving part 120 is increased toward the impact bar 200. To this end, as shown in FIG. 3, the thickness of the receiving part 120 is reduced toward the impact bar 200, so that an inclination surface 150 is formed as shown in FIG. 3.

Meanwhile, the impact bar 200 received in the receiving part 120 is formed with the diameter reduced toward the receiving part 120 and thus spaced apart from both inner lateral sides of the receiving part 120 by a specific distance.

In other words, as shown in FIG. 3, the receiving part 120 has the diameter increased downward and the impact bar 200 has the diameter reduced upward. Accordingly, when viewed in the whole appearance, the outer surface of the impact bar 200 is spaced apart from the inner surface of the receiving part 120 by a predetermined distance.

According to the present invention, even if the striking part 300 is moved forward and backward while forming an inclination angle, the impact bar 200 does not make mutual contact with the inside of the receiving part 120 so that scratches are prevented, differently from that of the related art. Accordingly, cracks are prevented, differently from that of the related art, so that the durability and strength can be improved.

In addition, as described above, since the thickness of the piston 100 is reduced due to the inner inclination surface 150 of the piston 100, the weight of the piston 100 is reduced, so that the durability may be improved.

Meanwhile, the contact part 130 serving as the bottom surface of the receiving part 120 and making contact with the impact bar 200 protrudes toward the impact bar 200 by a predetermined height, and both sides of the contact part 130 may have buffer grooves 140 curved with a predetermined curvature as shown in FIG. 3.

In other words, as shown in FIG. 3, due to the contact part 130 according to the present invention more protruding downward by a distance L when comparing with that of the related art, heat may be more efficiently radiated when the contact part 130 and the top surface of the impact bar 200 strike each other.

The buffer grooves 140 curved with the predetermined curvature are formed at both sides of the contact part 130 to prevent the transfer of an impact wave when impact occurs. In other words, if the buffer grooves 140 are not formed, the impact wave formed due to the impact between the contact part 130 and the impact bar 200 is propagated to the entire portion of the piston 100. However, the buffer grooves 140 according to the present invention prevent the transfer of the impact wave, so that the strength may be improved.

Meanwhile, the buffer grooves 140 may prevent stress from being concentrated when due to the rapid change of the sectional surface thereof when formed with the predetermined curvature as described above. The buffer grooves 140 may be formed at left and right sides of the contact part 130, respectively, as shown in FIG. 3 (see reference numerals 141 and 142).

A noise insulating material 160 may be provided on one inner lateral side of the receiving part 120. In other words, as the impact bar 200 is inserted into the receiving part 120 and noise is caused due to the impact between the impact bar 200 and the receiving part 120, the noise insulating material 160 is provided on one inner lateral side of the receiving part 120 to prevent noise from being propagated.

Meanwhile, the noise insulating material 160 may include various materials in various shapes as well-known to those skilled in the art.

Meanwhile, a plurality of steps 220 for the attenuation of noise may be formed on an outer lateral side of the impact bar 200.

In other words, as shown in FIG. 3, when the steps 220 are formed with various heights on a portion of the outer lateral side of the impact bar 200, noises are mutually attenuated, so that a noise reduction effect may be improved.

In this case, the steps 220 may have a step shape, a pointed tip shape, or a curved tip shape.

In other words, the steps 220 for the attenuation of the noise according to the present invention aim at the noise reduction resulting from mutually attenuation of noises. Accordingly, as long as the steps 220 achieve the noise reduction, the steps 220 may have various shapes within the scope of the present invention.

Meanwhile, a contact surface 230 serving as an outer surface of the impact bar 200 and facing a bottom surface 110*a* of the piston 100 may be formed to be spaced apart from the bottom surface 110*a* by a predetermined distance when the contact part 130 of the receiving part 120 strikes the impact bar 200.

As described above, the impact bar 200 is formed in such a manner that the contact surface 230 of the impact bar 200 faces the bottom surface 110*a* of the piston 100 at a predetermined distance from the bottom surface 110*a* when the impact bar 200 is inserted into the receiving part 120 of the piston 100, and the contact part 130 of the piston 100 strikes the impact bar 200. Accordingly, the noise of the receiving part 120 may be attenuated when discharged to the outside.

A buffer part 400 is further provided between the bottom surface 110*a* and the contact surface 230, and may include a spring.

In other words, although the bottom surface 110*a* of the piston 100 and the contact surface 230 of the impact bar 200 may be formed to be spaced apart from each other, the bottom surface 110*a* may strike the contact surface 230 due to the elastic deformation of the piston 100 when impact occurs. Accordingly, since impact may occur, the impact may be buffered by the buffer 400 employing the spring.

In this case, the above-described buffer part 400 may employ the spring as shown in drawings, and may have the shape of a porous cylinder having a specific sectional surface and formed of an elastic material.

As described above, the above impact is reduced by the buffer part 400 to prevent noise and improve durability.

Meanwhile, as shown in FIG. 4, a plurality of heat sinks 500 may be provided on the inner lateral sides of the receiving part 120 or on the outer lateral sides of the impact bar 200.

In other words, the heat sink 500 has a wide surface area to easily radiate heat as well-known to those skilled in the art.

According to the present invention, as described above, a plurality of heat sinks 510 and 520 are provided on the inner lateral sides of the receiving part 120 or the outer lateral sides of the impact bar 200, so that heat emitted from the piston 100 and the impact bar 200 may be easily radiated toward the receiving part 120.

The heat emitted from the piston 100 and the heat sink 500 may be effectively removed by the heat sink 500 according to the present invention so that the strength and the durability may be improved.

Meanwhile, the heat sinks 500 may be formed with mutually different heights. In other words, as described above, the heat sinks 500 are formed on the inner lateral sides of the receiving part 120 or the outer lateral sides of the impact bar 200, and the space defined by the lateral sides is used to propagate noise. Accordingly, if the heat sinks 500 are formed with mutually different heights as described above, noises are mutually cancelled from each other, so that the noise reduction may be increased.

As described above, although the embodiments of the present invention have been described in detail for the illustrative purpose, the present invention is not limited thereto, and it should be understood that modifications or variations can be devised by those skilled in the art that will fall within the spirit and scope of the principles of the disclosure.

The simple modifications or variations fall within the scope of the present invention, and the detailed protection scope of the present invention will be clearly defined by appended claims.

What is claimed is:

1. A low-noise hydraulic hammer comprising:

an impact bar (200) formed in a striking part (300) and configured to be inserted into a receiving part (120) in a piston (100), wherein an inner lateral side wall of the receiving part (120) is inclinedly formed such that a diameter of the receiving part (120) is increased toward the impact bar (200), the impact bar (200) is received in the receiving part (120) to make contact with the piston (100), formed with a diameter reduced toward the receiving part (120), and spaced apart from the inner lateral side wall of the receiving part (120) by a specific distance, and a plurality of heat sinks (500) are mounted on the inner lateral side wall of the receiving part (120) or on an outer lateral side wall of the impact bar (200).

2. The low-noise hydraulic hammer of claim 1, further comprising:

a contact part (130) disposed in the receiving part (120) and protruding toward the impact bar (200) by a predetermined height for making contact with the impact bar (200); and a buffer groove (140) formed with a predetermined curvature and surrounding the contact part.

3. The low-noise hydraulic hammer of claim 1, further comprising:

a noise insulating material (160) provided on the inner lateral side wall of the receiving part (120).

4. The low-noise hydraulic hammer of claim 1, wherein the impact bar (200) has a plurality of steps (220) on the outer lateral side wall thereof for attenuation of noise.

5. The low-noise hydraulic hammer of claim 1, wherein the impact bar is formed such that a contact surface (230) of the striking part (300) surrounding the impact bar (200) is spaced apart from a bottom surface (110*a*) of the piston (100) by a predetermined distance when the contact part (130) strikes the impact bar (200).

6. The low-noise hydraulic hammer of claim 5, further comprising:

a buffer part (400) disposed on the contact surface (230) such that the buffer part (400) is interposed between the bottom surface (110*a*) and the contact surface (230).

7. The low-noise hydraulic hammer of claim 6, wherein the buffer part (400) is a spring or an elastic material having a shape of a porous cylinder having a specific sectional surface.

8. The low-noise hydraulic hammer of claim 1, wherein the heat sinks (500) have mutually different heights.

9. A low-noise hydraulic hammer comprising:

a housing;

a piston configured to move along the housing by oil or air pressure;

a receiving part formed at a central portion of a lower side of the piston, the receiving part being a hollow space enclosed by a body of the piston and open at a bottom side of the piston;

a contact part disposed at a central portion of a top side of the receiving part such that the contact part protrudes from the body of the piston toward the bottom side of the piston;

a buffer groove formed inside the receiving part with a shape of ditch and surrounding the contact part;

a striking part configured to move by impact applied by the piston; and an impact bar formed on a top surface of the striking part and configured to be inserted into the receiving part, wherein when the contact part contacts with a top surface of the impact bar to apply the impact, a lateral side wall of the impact part is spaced apart from a lateral side wall of the receiving part by a specific distance.

10. The low-noise hydraulic hammer of claim 9, further comprising:

a noise insulating material provided on the lateral side wall of the receiving part.

11. The low-noise hydraulic hammer of claim 9, wherein a diameter of the receiving part is increased toward the bottom side of the piston, and a diameter of the impact bar is increased toward the striking part.

12. The low-noise hydraulic hammer of claim 11, wherein the impact bar has a plurality of steps on the lateral side wall thereof for attenuation of noise.

13. The low-noise hydraulic hammer of claim 9, wherein the impact bar is formed such that a contact surface formed around the impact bar on the top surface of the striking part is spaced apart from a bottom surface of the piston by a predetermined distance when the contact part strikes the impact bar.

14. The low-noise hydraulic hammer of claim 13, further comprising:

a buffer part disposed on the contact surface such that the buffer part is interposed between the bottom surface and the contact surface.

15. The low-noise hydraulic hammer of claim 14, wherein the buffer part is a spring or an elastic material having a shape of a porous cylinder having a specific sectional surface.

16. The low-noise hydraulic hammer of claim 9, further comprising a plurality of heat sinks mounted on the lateral side wall of the receiving part or on the lateral side wall of the impact bar.

17. The low-noise hydraulic hammer of claim 16, wherein the heat sinks have different heights each other.

* * * * *